US009801486B2

(12) United States Patent
Mullet et al.

(10) Patent No.: US 9,801,486 B2
(45) Date of Patent: Oct. 31, 2017

(54) CROSSOVER BRACKET FOR DRAPERY

(71) Applicant: QMotion Incorporated, Pensacola, FL (US)

(72) Inventors: Willis Jay Mullet, Gulf Breeze, FL (US); Michael D. Fox, Pensacola, FL (US)

(73) Assignee: Current Products Corp., Pensacola, FL (US)

( * ) Notice: Subject to any disclaimer, the term of this patent is extended or adjusted under 35 U.S.C. 154(b) by 27 days.

(21) Appl. No.: 14/712,551

(22) Filed: May 14, 2015

(65) Prior Publication Data

US 2015/0327705 A1 Nov. 19, 2015

Related U.S. Application Data

(60) Provisional application No. 62/000,063, filed on May 19, 2014.

(51) Int. Cl.
*A47H 1/00* (2006.01)
*A47H 5/02* (2006.01)
(Continued)

(52) U.S. Cl.
CPC ..... *A47H 5/02* (2013.01); *A47H 1/02* (2013.01); *A47H 23/01* (2013.01); *A47H 5/06* (2013.01); *A47H 2001/0215* (2013.01)

(58) Field of Classification Search
CPC ..... A47H 1/00; A47H 2001/0215; A47H 2001/003; A47H 1/04; A47H 5/06;
(Continued)

(56) References Cited

U.S. PATENT DOCUMENTS

D5,178 S 8/1871 Gould
D22,271 S 3/1893 Ruxton
(Continued)

FOREIGN PATENT DOCUMENTS

DE 3402122 8/1984
JP 2006304984 11/2006
(Continued)

OTHER PUBLICATIONS

European Search Report, EP13837043.2, PCT-US2013-060205, dated Jun. 27, 2016.
(Continued)

*Primary Examiner* — Katherine Mitchell
*Assistant Examiner* — Jeremy Ramsey
(74) *Attorney, Agent, or Firm* — Christopher A. Proskey; BrownWinick Law Firm

(57) ABSTRACT

A drapery system that operates by rotating a rod having one, or a pair of left hand twist helical grooves, and one or a pair of right hand twist helical grooves, where the left hand twist and right hand twist helical grooves cross one another in equal spaced alignment across the length of the rotating rod. A plurality of idler rings and at least one driver ring are positioned around the drapery rod. The idler rings have a smooth interior surface whereas the driver rings include at least one tooth that engages a helical groove of the rotating rod. As the rotating rod is rotated, the driver ring is driven across the length of the rotating rod, thereby opening and closing the system. The system also includes a mounting bracket allows for extending the drapery past the inward edge of the inward most ring.

30 Claims, 14 Drawing Sheets

(51) Int. Cl.
*A47H 23/01* (2006.01)
*A47H 1/02* (2006.01)
*A47H 5/06* (2006.01)

(58) Field of Classification Search
CPC .... A47H 23/00; A47H 5/02; A47H 2005/025; A47H 5/0325; A47H 5/00; E06B 2009/6818; E06B 2009/6809; E06B 9/68; E06B 9/72; Y10T 16/353
See application file for complete search history.

(56) References Cited

U.S. PATENT DOCUMENTS 537,681 A 4/1895 Furbish
D25,521 S 5/1896 Ill
D41,567 S 7/1911 Rouse
1,823,909 A * 9/1931 Meier ..... A47H 5/06 160/343
1,934,859 A * 11/1933 Joaquin ..... E05F 15/77 200/83 R
2,801,690 A 8/1957 Bennett
3,208,507 A 9/1965 Breen
3,631,659 A 1/1972 Horowitz
3,774,665 A * 11/1973 Bourne ..... A47H 5/06 16/87.6 R
3,853,166 A 12/1974 Wrono
3,930,738 A 1/1976 Thuss et al.
3,999,110 A 12/1976 Ramstrom et al.
4,023,609 A 5/1977 Rosenquist
4,096,903 A 6/1978 Ringle, III
4,131,831 A 12/1978 Bochenek et al.
4,160,348 A 7/1979 Chapman et al.
4,171,845 A 10/1979 Hirsch
4,223,714 A 9/1980 Weinreich et al.
4,305,448 A 12/1981 Stoll
4,399,855 A 8/1983 Volfson
4,427,050 A 1/1984 Toppen
RE31,793 E 1/1985 Berman et al.
4,495,978 A 1/1985 Carroll
4,532,194 A 7/1985 Liautaud et al.
4,572,467 A 2/1986 Farrell
4,644,244 A 2/1987 Kittelson
4,724,885 A 2/1988 Chang
4,731,965 A 3/1988 Jensen
4,766,941 A 8/1988 Sloop et al.
4,807,686 A 2/1989 Schnebly et al.
4,831,509 A 5/1989 Jones et al.
4,832,104 A 5/1989 De Labarthe et al.
4,865,107 A 9/1989 Dube
4,926,922 A 5/1990 Shimazaki
4,956,588 A 9/1990 Ming
4,979,582 A 12/1990 Forster
D315,415 S 3/1991 Anthony et al.
5,054,605 A 10/1991 Bavis
D324,328 S 3/1992 Pagan
D324,645 S 3/1992 Magro et al.
5,123,079 A 6/1992 Tanii et al.
5,133,330 A 7/1992 Sharp
5,133,399 A 7/1992 Hiller et al.
5,271,446 A 12/1993 Hwang
5,278,480 A 1/1994 Murray
5,307,856 A * 5/1994 Murray ..... E06B 9/70 160/22
D355,353 S 2/1995 Pozzi
D355,587 S 2/1995 Pozzi
5,419,010 A 5/1995 Mullet
5,434,487 A 7/1995 Long et al.
5,445,209 A 8/1995 Lichy
5,462,105 A 10/1995 Supernak
5,467,808 A 11/1995 Bell
5,482,100 A 1/1996 Kuhar
5,509,239 A 4/1996 Fullwood
5,547,008 A 8/1996 Sullivan
5,566,736 A 10/1996 Crider et al.
5,655,342 A 8/1997 Guillemet et al.
5,655,343 A 8/1997 Seals
5,714,855 A 2/1998 Domel et al.
D391,476 S 3/1998 Gourlay
5,729,103 A 3/1998 Domel et al.
5,752,557 A 5/1998 Crider et al.
5,760,558 A 6/1998 Popat
5,785,105 A 7/1998 Crider et al.
5,793,174 A 8/1998 Kovach et al.
5,813,447 A 9/1998 Lysyj
RE36,058 E 1/1999 Sokol
5,883,480 A 3/1999 Domel et al.
5,889,377 A 3/1999 Mao
5,905,442 A 5/1999 Mosebrook et al.
5,907,227 A 5/1999 Domel et al.
5,929,580 A 7/1999 Mullet et al.
5,960,847 A 10/1999 Crider et al.
5,990,646 A 11/1999 Kovach et al.
6,004,298 A 12/1999 Levander
D418,741 S 1/2000 Rouse
6,020,829 A 2/2000 Hormann
6,024,156 A * 2/2000 Chu ..... A47H 5/0325 160/331
6,055,885 A 5/2000 Shea
6,060,852 A 5/2000 Domel et al.
6,069,465 A 5/2000 De Boois et al.
6,082,433 A 7/2000 Vafaie et al.
6,125,907 A 10/2000 Tokuyama et al.
6,144,177 A 11/2000 Mao
6,181,089 B1 1/2001 Kovach et al.
6,189,592 B1 2/2001 Domel
6,212,221 B1 4/2001 Wakayama et al.
6,259,218 B1 7/2001 Kovach et al.
6,286,579 B1 9/2001 Gottschalk
6,369,530 B2 4/2002 Kovach et al.
6,376,832 B1 4/2002 Smith et al.
6,433,498 B1 8/2002 Domel et al.
6,489,169 B1 12/2002 Cohen et al.
6,497,267 B1 12/2002 Azar et al.
6,533,017 B1 3/2003 Toti
6,550,733 B1 4/2003 Lassen et al.
6,606,072 B1 8/2003 Hayward et al.
6,680,594 B2 1/2004 Huber et al.
6,708,750 B2 3/2004 Collett et al.
6,733,413 B2 5/2004 Lagarde et al.
6,736,186 B2 5/2004 Anderson et al.
6,850,017 B1 2/2005 Domel et al.
6,870,338 B2 3/2005 Walker et al.
6,959,748 B2 11/2005 Hudoba
6,967,565 B2 11/2005 Lingemann
6,979,962 B2 12/2005 Cavarec et al.
7,033,695 B2 4/2006 Sawachi
7,104,305 B1 9/2006 Apollon
7,111,659 B2 9/2006 Harper et al.
7,137,530 B2 11/2006 Chirnomas
7,193,502 B2 3/2007 Vandrunen et al.
7,231,953 B2 6/2007 Varley et al.
7,240,716 B2 7/2007 Nichols, Jr. et al.
7,242,162 B2 * 7/2007 Goth ..... E04F 10/0659 160/7
7,259,485 B2 8/2007 Cavarec et al.
D553,965 S 10/2007 Ellbogen
7,281,561 B2 10/2007 Anderson et al.
7,299,848 B2 11/2007 Streib et al.
7,346,016 B2 3/2008 Nielsen et al.
7,350,736 B2 4/2008 Caamano et al.
7,356,041 B2 4/2008 Nielsen et al.
7,389,806 B2 6/2008 Kates
7,438,111 B2 10/2008 Grimes et al.
7,590,433 B2 9/2009 Sung et al.
7,673,667 B2 3/2010 Domel et al.
7,690,414 B2 4/2010 Knowles
7,931,068 B2 4/2011 Carmen, Jr. et al.
7,975,748 B2 7/2011 Yu et al.
8,125,167 B1 2/2012 Mullet et al.
8,299,734 B2 10/2012 Mullet et al.
8,340,975 B1 12/2012 Rosenberger
8,368,328 B2 2/2013 Mullet et al.
8,371,358 B1 2/2013 Mullet et al.
8,540,005 B2 9/2013 Baugh et al.

(56) References Cited

U.S. PATENT DOCUMENTS

| | | | | |
|---|---|---|---|---|
| 8,575,872 | B2 | 11/2013 | Mullet et al. | |
| 8,659,246 | B2 | 2/2014 | Mullet et al. | |
| 8,723,455 | B2 | 5/2014 | Mullet et al. | |
| 8,757,239 | B2 | 6/2014 | Colson et al. | |
| D714,132 | S | 9/2014 | Hazantonis | |
| 8,892,262 | B2 | 11/2014 | Mullet et al. | |
| 8,919,419 | B2 | 12/2014 | Mullet et al. | |
| 8,968,900 | B2 | 3/2015 | Mullet et al. | |
| 9,045,939 | B2 | 6/2015 | Blair et al. | |
| 2004/0169116 | A1 | 9/2004 | Nogare et al. | |
| 2006/0000565 | A1 | 1/2006 | Billebault | |
| 2006/0086874 | A1 | 4/2006 | Habel et al. | |
| 2007/0261801 | A1 | 11/2007 | Mullet et al. | |
| 2007/0284053 | A1 | 12/2007 | Mullet et al. | |
| 2009/0127369 | A1 | 5/2009 | Mullet et al. | |
| 2011/0056630 | A1 | 3/2011 | Buccola, Jr. | |
| 2011/0247174 | A1* | 10/2011 | Keishold ..... | A47H 1/02 16/87.4 R |
| 2012/0181979 | A1 | 7/2012 | Hudspeth et al. | |
| 2012/0279075 | A1 | 11/2012 | Amsel | |
| 2013/0199735 | A1 | 8/2013 | Colson et al. | |
| 2013/0204408 | A1 | 8/2013 | Thiruvengada et al. | |
| 2013/0333848 | A1 | 12/2013 | Mullet et al. | |
| 2014/0014281 | A1 | 1/2014 | Mullet et al. | |

FOREIGN PATENT DOCUMENTS

| | | |
|---|---|---|
| JP | 2006314389 | 11/2006 |
| JP | 2009034301 | 2/2009 |
| JP | 2011062497 | 3/2011 |
| KR | 100903201 | 6/2009 |
| KR | 20100006476 | 1/2010 |
| WO | 8602970 | 5/1986 |

OTHER PUBLICATIONS

International Preliminary Report on Patentability, PCT/US2013/060205, dated Mar. 26, 2015.

International Search Report, PCT/US2014/045633, dated Nov. 7, 2014.

Written Opinion of the International Searching Authority, PCT/US2014/045663, dated Nov. 7, 2014.

* cited by examiner

CROSSOVER BRACKET FOR DRAPERY

CROSS REFERENCE TO RELATED APPLICATION

This application claims the benefit of U.S. Provisional Application No. 62/000,063 filed May 19, 2014.

FIELD OF THE INVENTION

This invention relates to window coverings. More specifically, and without limitation, this invention relates to drapery-type window coverings.

BACKGROUND OF THE INVENTION

Window coverings, such as curtains, shades, blinds, etc., are frequently used to provide privacy and to limit the amount of light that is permitted to pass through a window and into a building or room.

There are numerous types of window coverings known in the art. Of particular interest to this application is a unique type of drapery device known as a rotating rod drapery apparatus manufactured by QMotion Advanced Shading Systems having an address of 3400 Copter Road, Pensacola, Fla. 32514. These rotating rod drapery systems are the subject of a plurality of U.S. patent applications, all of which are fully incorporated herein by reference, including U.S. application Ser. No. 13/842,586, filing date Mar. 15, 2013, publication date Mar. 20, 2014, entitled "Drapery tube incorporating batteries within the drapery tube, with a stop for facilitating the loading and unloading of the batteries;" U.S. application Ser. No. 13/841,732, filing date Mar. 15, 2013, publication date Mar. 20, 2014, entitled "Method and apparatus for cutting one or more grooves in a cylindrical element;" U.S. application Ser. No. 14/029,210, filing date Sep. 17, 2013, publication date Mar. 20, 2014, entitled "Rotatable drive element for moving a window covering;" U.S. application Ser. No. 13/843,617, filing date Mar. 15, 2013, publication date Mar. 20, 2014, entitled "Method and apparatus for linked horizontal drapery panels having varying characteristics to be moved independently by a common drive system;" among others, all of which are incorporated herein by reference.

These rotating rod drapery systems operate by rotating a rod having one, or a pair of left hand twist helical grooves positioned on opposite sides of the rod from one another, and one or a pair of right hand twist helical grooves positioned on opposite sides of the rod from one another, where the left hand twist and right hand twist helical grooves cross one another in equal spaced alignment across the length of the rotating rod.

These drapery systems include a plurality of idler rings positioned around the drapery rod, and at least one driver ring. The idler rings have a smooth interior surface that are unaffected by the rotating drapery rod and its helical guide structures. In contrast, the driver rings include at least one tooth that engages a helical groove of the rotating rod. As the rotating rod is rotated, the driver ring is driven across the length of the rotating rod, thereby opening and closing the shade material hung on the idler rings and the driver rings.

In these prior drapery systems, the driver ring was positioned as the inward most or the second inward most ring. Positing the driver ring in this manner allowed the rotating rod to open and close the drapery. While this arrangement worked for some applications, problems remained.

Namely, as the driver ring was driven across the length of the rotating rod, the driver ring had a tendency to tilt out of perpendicular alignment with the rotating rod. This increased the friction between the rotating rod and the driver ring which had the tendency to catch or hang-up on the rotating rod and when this occurred the driver ring would wrap around the rotating rod, which could have catastrophic effects.

Another substantial disadvantage to this arrangement was that the closer the dimensions are controlled between the teeth of the driver ring the more the driver ring could be prevented from tilting on the rotating rod. However, the tighter the tolerances between the teeth of the driver ring and the groove of the helical guide structure the greater the potential for the teeth to get hung-up or catch on an aberration in the surface of the rotating rod or an aberration in the groove. This is especially true at an interface where a right-hand-twist helical groove crosses a left-hand-twist helical groove. As such, using a only a single driver ring presented great challenges because only a single aberration in the surface of the entire drapery rod or helical groove could cause the device to fail.

In addition, when there is only a single driver ring, it only takes a single driver ring to get off track. As such, it was discovered that a single driver ring was not as robust a design as it could be.

Also, it was found that having a single driver ring positioned as the inward most ring or the second inward most ring, on a center closing drapery system often left a light gap at the center of the system. This is because overlap of the two opposing drapes was hard or impossible to accomplish. This is because, if the drapery was extended past the inside edge of the driver ring this would cause the driver ring to tilt. This tilting was aesthetically displeasing as the inward most ring would appear out of alignment with the other idler rings. In addition, as discussed above, the more the driver ring tilts, the more likely it is that the driver ring will catch on or hang-up on the rotating drapery rod.

For the reasons stated above, and for other reasons stated below which will become apparent to those skilled in the art upon reading and understanding the specification, there is a need in the art for an improved driver for a drapery system.

Thus, it is a primary object of the invention to provide an improved driver for a drapery system and method of use that improves upon the state of the art.

Another object of the invention is to provide an improved driver for a drapery system and method of use that reduces the light gap between drapes.

Yet another object of the invention is to provide an improved driver for a drapery system and method of use that improves the overlap between opposing drapes.

Another object of the invention is to provide an improved driver for a drapery system and method of use that provides smoother opening and closing.

Yet another object of the invention is to provide an improved driver for a drapery system and method of use that provides better alignment for the driver rings.

Another object of the invention is to provide an improved driver for a drapery system and method of use that reduces the potential for catastrophic events.

Yet another object of the invention is to provide an improved driver for a drapery system and method of use that allows for the use of an overlap bracket.

Another object of the invention is to provide an improved driver for a drapery system and method of use that is adjustable.

Yet another object of the invention is to provide an improved driver for a drapery system and method of use that is easy to use.

Another object of the invention is to provide an improved driver for a drapery system and method of use that is durable.

Yet another object of the invention is to provide an improved driver for a drapery system and method of use that has an intuitive design.

Another object of the invention is to provide an improved driver for a drapery system and method of use that has a minimum number of parts.

Yet another object of the invention is to provide an improved driver for a drapery system and method of use that has a long useful life.

Another object of the invention is to provide an improved driver for a drapery system and method of use that provides a convenient mounting place for an activating device.

Yet another object of the invention is to provide an improved driver for a drapery system and method of use that allows the inner edge of a drapery panel to be extended inward from a driver ring.

Another object of the invention is to provide an improved driver for a drapery system and method of use that prevents or reduces a driver ring from hanging-up or catching on the drapery rod.

Yet another object of the invention is to provide an improved driver for a drapery system and method of use that reduces the need to closely control the dimensions between the drapery rod and the driver ring.

Another object of the invention is to provide an improved driver for a drapery system and method of use that provides more give and forgiveness to the system.

Yet another object of the invention is to provide an improved driver for a drapery system and method of use that improves safety.

Another object of the invention is to provide an improved driver for a drapery system and method of use that improves convenience.

Yet another object of the invention is to provide an improved driver for a drapery system and method of use that improves the universality of the device.

Another object of the invention is to provide an improved driver for a drapery system and method of use that reduces false activation of the device.

Yet another object of the invention is to provide an improved driver for a drapery system and method of use that improves repeatable activation of the device.

These and other objects, features, or advantages of the invention will become apparent from the specification and claims.

SUMMARY OF THE INVENTION

A rotating rod drapery system is presented with a crossover bracket. The rotating rod drapery system operates by rotating a rod having one, or a pair of left hand twist helical grooves positioned on opposite sides of the rod from one another, and one or a pair of right hand twist helical grooves positioned on opposite sides of the rod from one another, where the left hand twist and right hand twist helical grooves cross one another in equal spaced alignment across the length of the rotating rod. A plurality of idler rings and at least one driver ring are positioned around the drapery rod. The idler rings have a smooth interior surface whereas the driver rings include at least one tooth that engages a helical groove of the rotating rod. As the rotating rod is rotated, the driver ring is driven across the length of the rotating rod, thereby opening and closing the shade material hung on the idler rings and the driven rings. The system includes a pair of driver rings connected together by a mounting bracket that helps to maintain the perpendicular alignment of the two driver rings with respect to the drapery rod. In addition, the mounting bracket allows for extending the drapery past the inward edge of the inward most ring. In addition, the mounting bracket provides a convenient place to mount an activating device. As such, the crossover bracket provides smoother operation, less chance for a catastrophic event, a convenient place to connect an activating device and allows for opposing drapery panels to be overlapped with one another thereby eliminating light gaps.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end, sides, and the like, are referenced according to the views presented. It should be understood, however, that the terms are used only for purposes of description, and are not intended to be used as limitations. Accordingly, orientation of an object or a combination of objects may change without departing from the scope of the invention.

Figure 1:
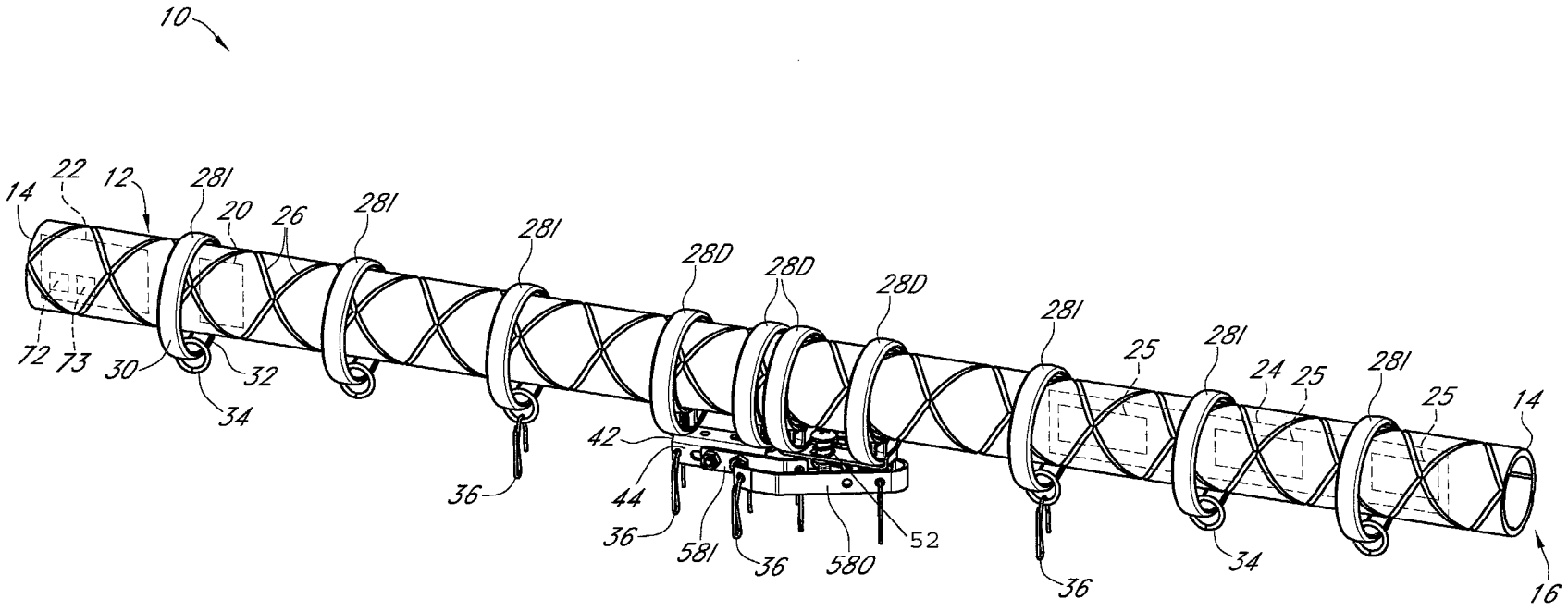
FIG. 1 is a perspective view of a rotating drapery rod having a pair of right hand twist helical grooves positioned on opposite sides of the drapery rod from one another, and a pair of left hand twist helical grooves positioned on opposite sides of the drapery rod from one another, the two pairs of helical grooves intersecting with one another across the length of the drapery rod in spaced relation, the view also showing a plurality of idler rings positioned behind a pair of crossover brackets, the view showing the crossover brackets in closed, overlapped, condition.
Figure 2:
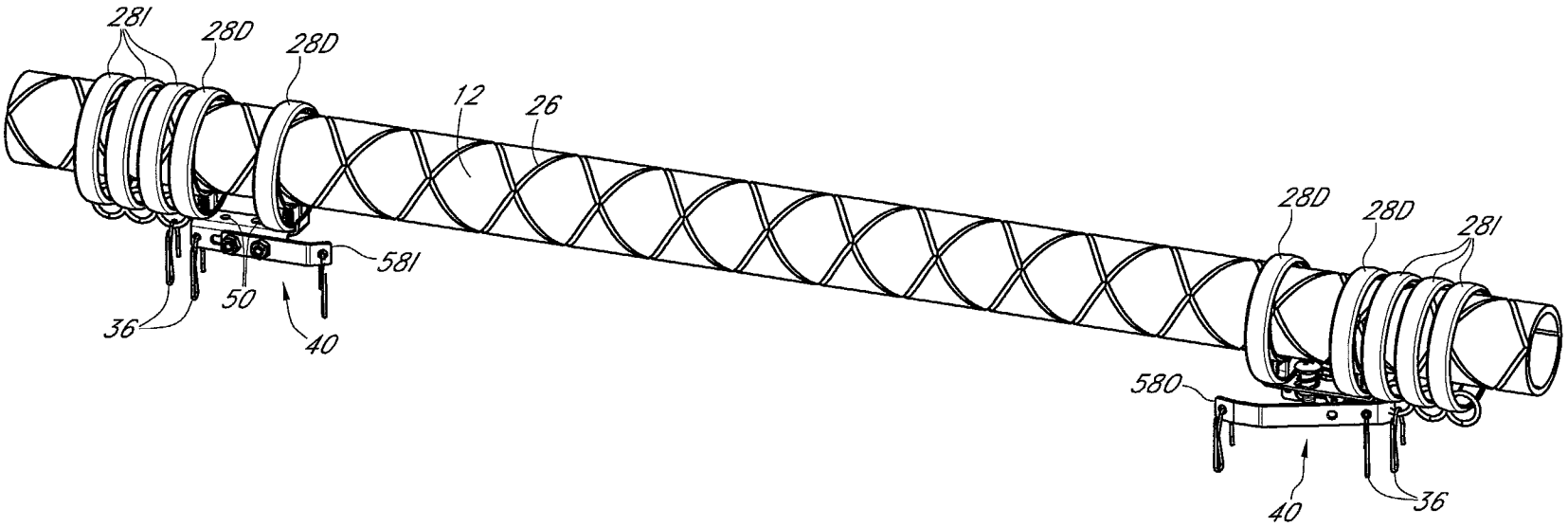
FIG. 2 is a perspective view of FIG. 1, with the crossover brackets in open condition.
Figure 3:
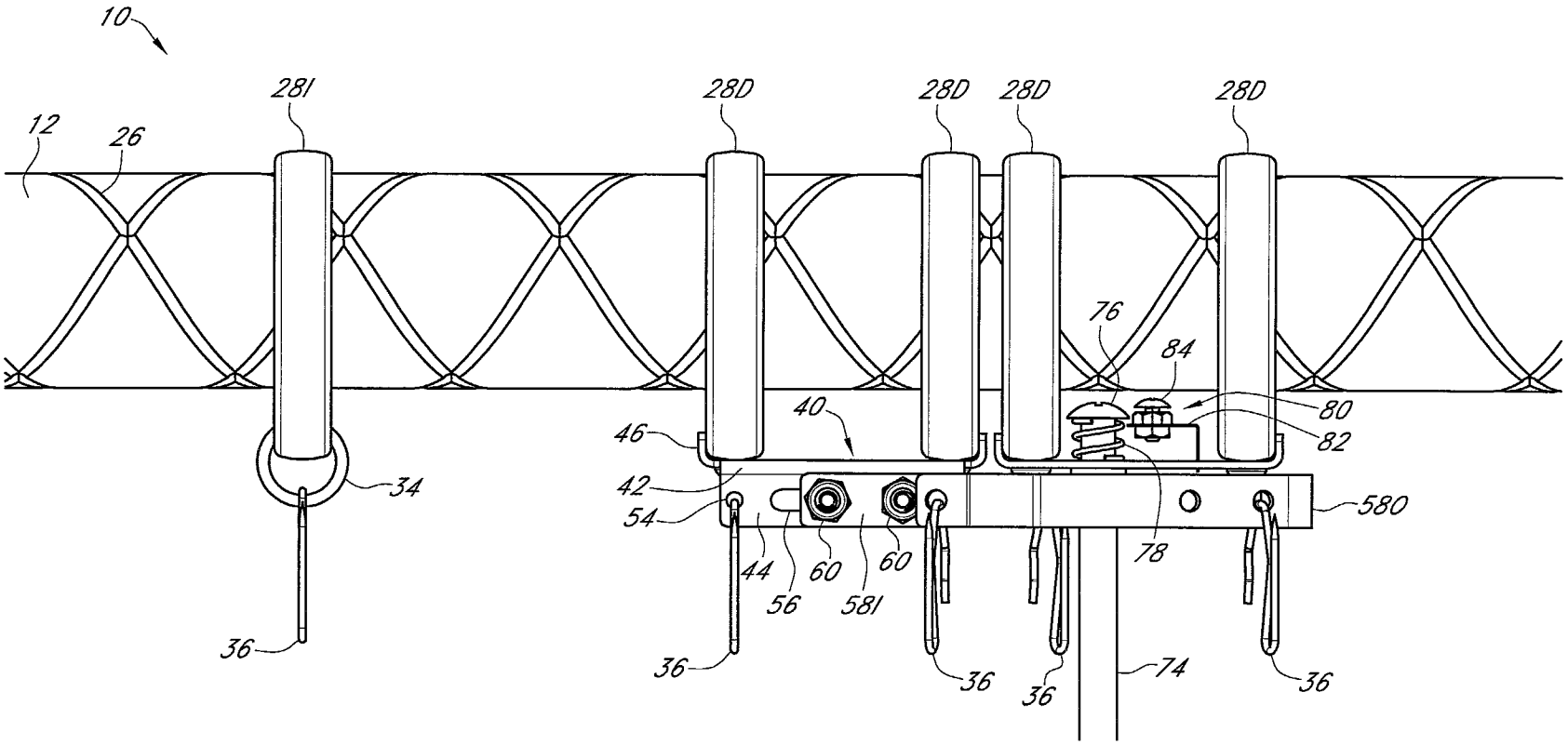
FIG. 3 is a close-up elevation view of the crossover brackets of FIG. 1 in a closed, overlapped, condition.
Figure 4:
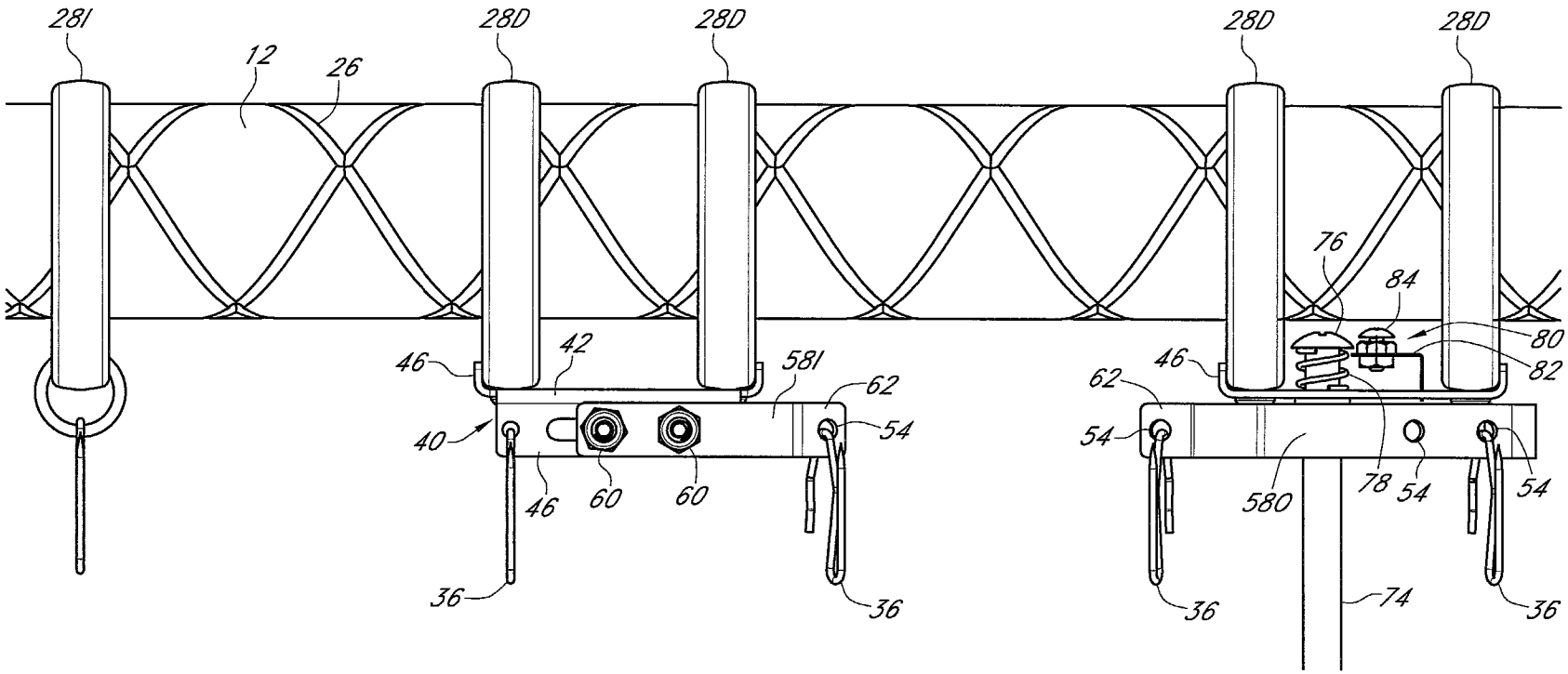
FIG. 4 is a close-up elevation view of the crossover brackets of FIG. 3 in a slightly open condition.
Figure 5:
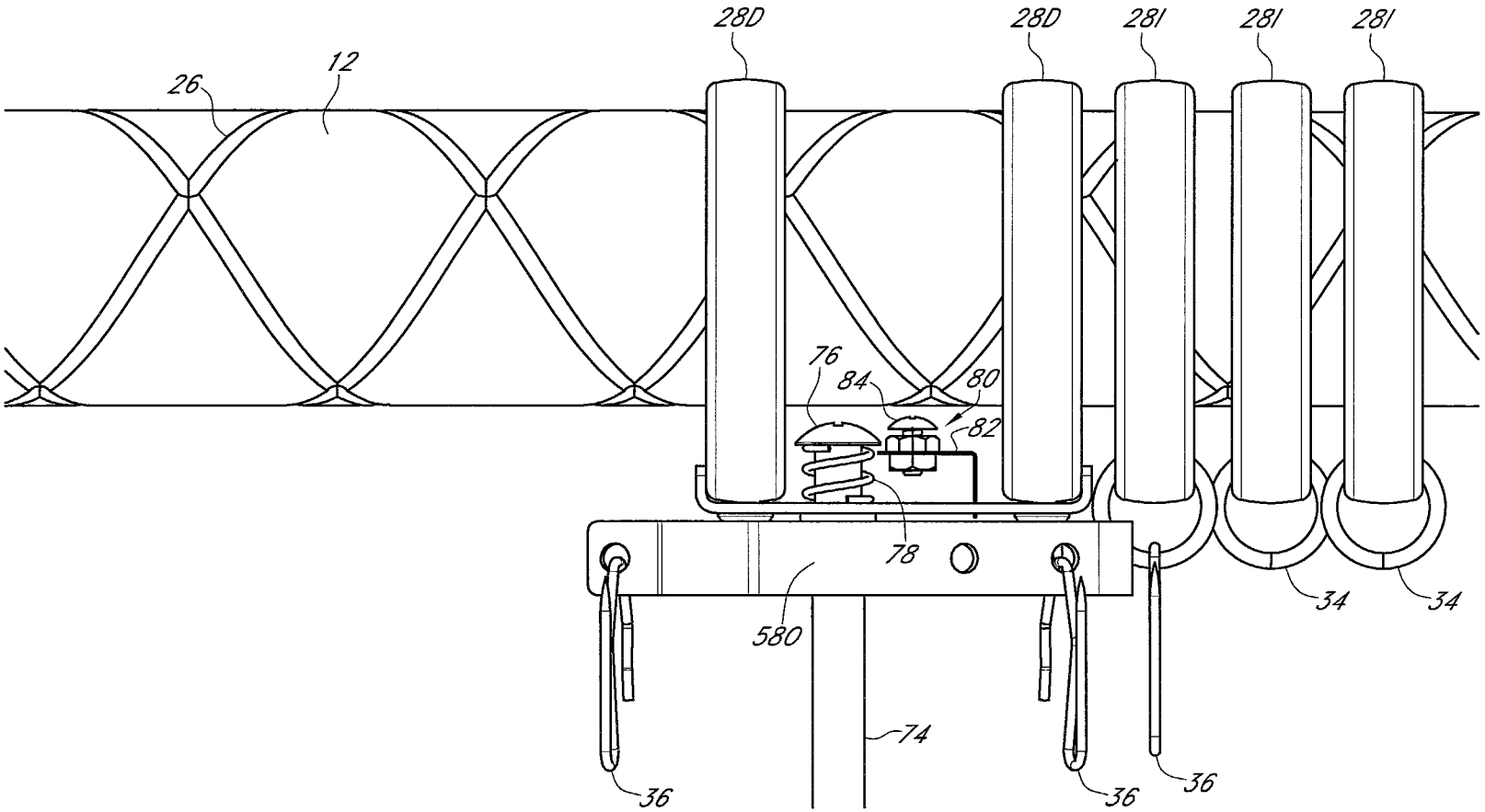
FIG. 5 is a tighter close-up view of the right crossover bracket of FIG. 4, the view showing the activating device positioned between the first driver ring and the second driver ring and supported by the horizontal member.
Figure 6:
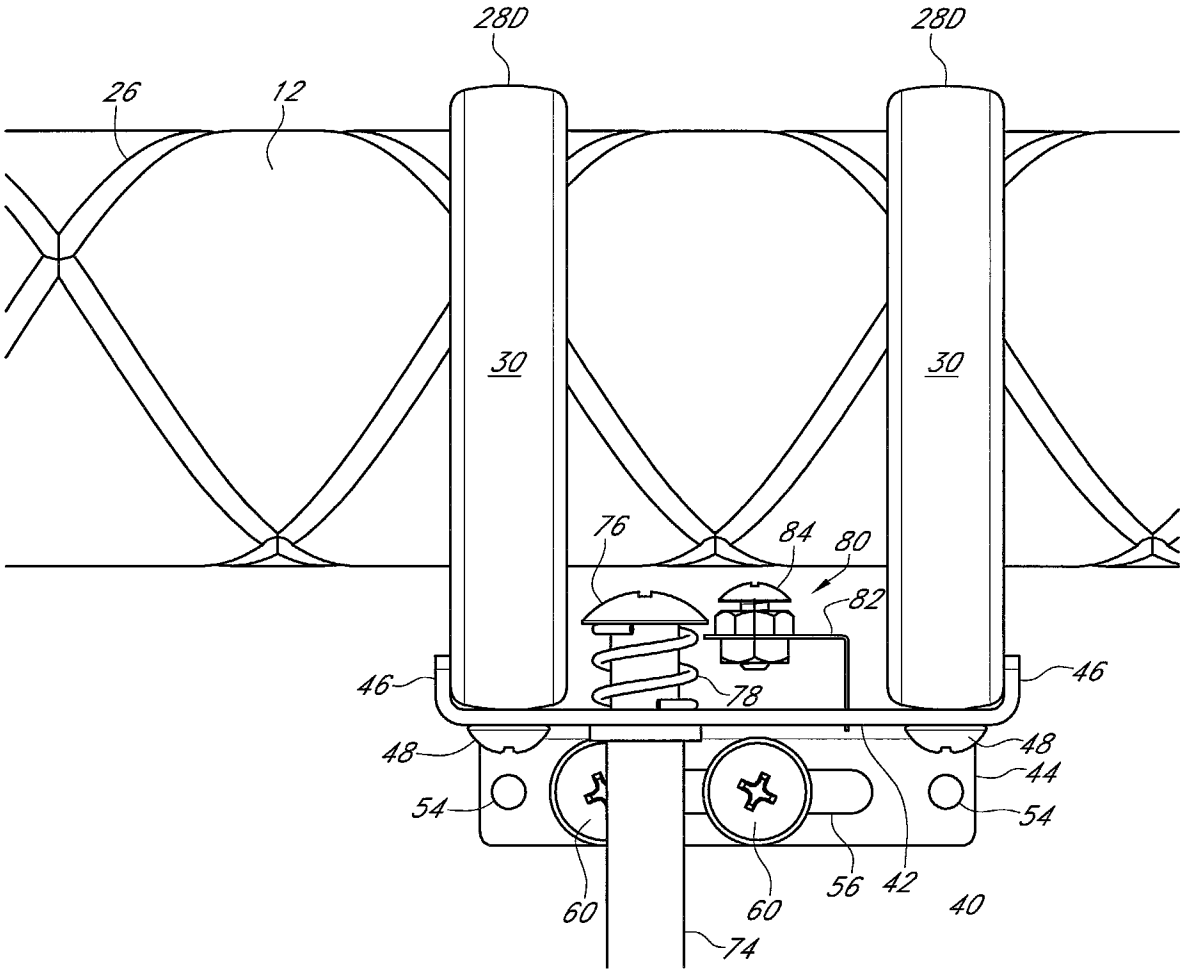
FIG. 6 is a tighter close-up view of the crossover bracket of FIG. 5, the view showing the activating device positioned between the first driver ring and the second driver ring and supported by the horizontal member.
Figure 7:
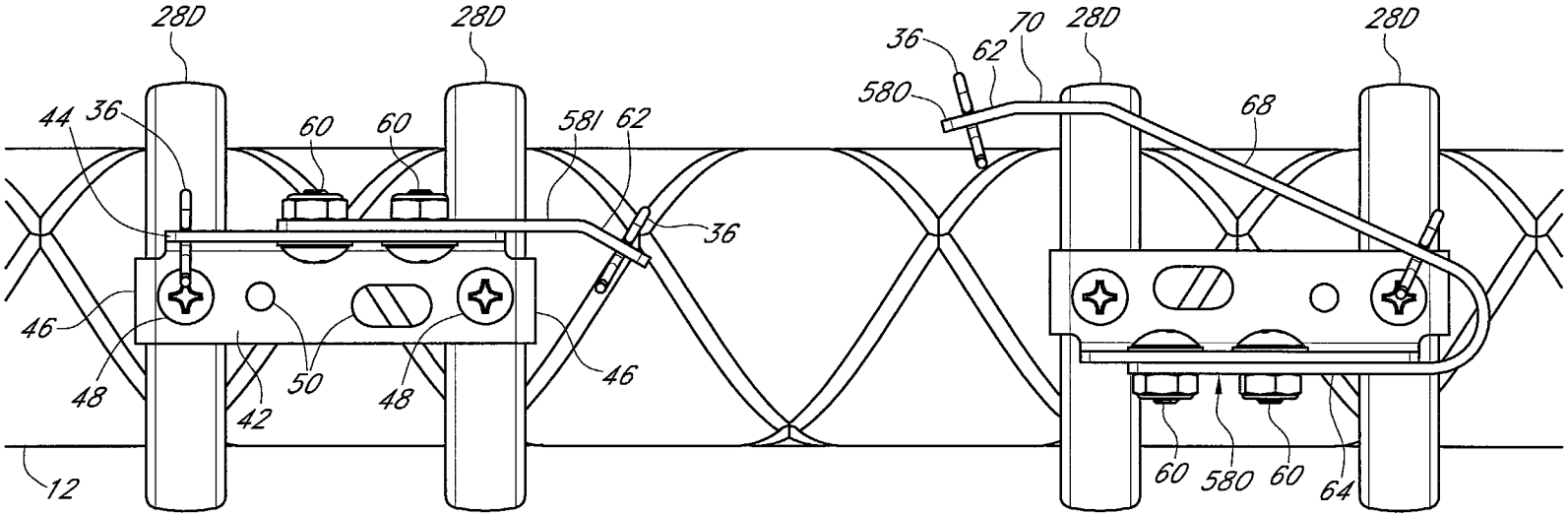
FIG. 7 is a close-up bottom elevation view of arrangement of FIG. 4, with the two crossover brackets in a partially opened position.

With reference to FIG. 1, a rotating rod drapery system is presented with respect to reference numeral 10. The system 10 includes a rotating rod or drapery rod 12 that is formed of any suitable size, shape and design. In the arrangement shown, rod 12 extends a length between opposing ends 14 and is generally cylindrical in shape. The rod 10 has a hollow interior 16 that, in some arrangements, houses components of the system such as a motor housing 18 that contains a motor 20 and a motor controller 22, and other components such as a power source 24 such as a housing holding a plurality of conventional batteries 25.

Rod 12 includes guide structure 26 in its exterior surface. Guide structure 26 is any form of a guide positioned on or in the surface of rod 10. In the arrangement shown, guide structure 26 is formed of a pair of left hand twist helical grooves positioned on generally opposite sides of the rod 12 from one another, and a pair of right hand twist helical grooves positioned on generally opposite sides of the rod from one another. The pair of left hand twist and the pair of right hand twist helical grooves cross one another in equal spaced alignment across the length of the rotating rod 12. In this way, the two left hand twist helical grooves cross the two right hand twist helical grooves in approximate perpendicular alignment to one another along the length of the rotating rod 12. In this way, the four helical grooves form the guide structure 26 in the arrangement shown, however, the guide structure 26 can be formed of more grooves such as five, six, seven, eight, nine, ten or more; or less grooves such as one, two or three. Alternatively, the guide structure 26 can be formed of any number of protrusions in the surface of the rotating rod 12, such as raised rails or threads or the like.

A plurality of rings 28 are positioned around rod 12. Rings 28 are formed of any suitable size, shape and design. In the arrangement shown, rings 28 are generally cylindrical in shape and are sized to fit over the rod 12. Two types of rings 28 are presented, driver rings 28D and idler rings 28I. The term "rings" used without the modifiers "idler" or "driver" shall refer to all rings 28.

Rings 28 are, in one arrangement, formed a cover or exterior 30 that surrounds an insert 32 therein. In one arrangement, the exterior 30 is formed of a hard or metallic material with a plastic or composite interior insert 32 that is partially flexible or more forgiving than metal. The metallic exterior 30 provides for desirable aesthetic exterior appearance and allows the rings 28 to have the same appearance as the rod 12, while the plastic or composite interior insert 32 allows the rings 28 to smoothly slide over the surface of the rotating rod 12 and also provides some noise reduction and give due to the fact that the plastic or composite is slightly compressible and has favorable properties. In addition, in some arrangements, the use of various materials for insert 32 are self-lubricating over their life thereby improving sliding along rotating rod 12.

Idler rings 28I also include a loop 34 positioned around the idler ring 28I. Loop 34 is any form of a device that reaches around ring 28 and allows for connection of a drapery hook 36, clip or other device to support drapery material 38 or panel of fabric (not shown) that is connected directly to the drapery hooks 36, the loops 34, the rings 28 or any combination thereof.

Insert 32 of driver rings 28D include one or more teeth 39. Teeth 39 are formed of any suitable size, shape or design and are formed to fit within and ride within the guide structure 26 as rod 12 is rotated. Teeth 39 are themselves positioned within a recess 41 or groove in the interior surface of insert 32 and protrude outwardly therefrom. This groove or recess 41 allows for the passage of aberrations or burrs that are positioned along the length of guide structure 26 without derailing the driver ring 28D. These aberrations are often found positioned just outside of or along the edge of guide structure 26.

In the arrangement shown, two teeth 39 are positioned opposite one another, one positioned at the top dead center position, and bottom dead center position. Testing has revealed that positioning one tooth 39 at the top and one tooth 39 at the bottom helps to maintain the vertical alignment of the ring 28 as the rod 12 rotates. In an alternative arrangement, one tooth 39 is positioned at the right-most position or the three-o-clock position, whereas the other tooth 39 is positioned at the left-most position or the nine-o-clock position. In this arrangement, the weight of the ring 28 causes the top interior surface of the ring to engage and slide over the rotating rod 12 as the ring 28 moves along the length of the rotating rod 12 and as such in this arrangement the top interior surface is smooth. Alternatively, any other number of teeth 39 are hereby contemplated for use, as is any other positioning of the teeth 39, or the like.

A pair of driver rings 28D are positioned inward of a plurality or stack of idler rings 28I. These two driver rings 28D are connected together by a connecting bracket 40. Connecting bracket 40 is formed of any suitable size, shape and design. In the arrangement shown, connecting bracket 40 is formed of a horizontal member 42 and a vertical member 44 which are both generally flat and planar in shape. The horizontal member 42 is connected adjacent its forward edge or rearward edge to the top edge of vertical member 44 and in this way the horizontal member 42 and vertical member 44 are positioned in approximate perpendicular alignment to one another. The outward edges of the horizontal member 42 terminate in flanges 46 that extend upwardly. These upwardly extending flanges 46 engage the outward edges of the first driver ring 28D and the second driver ring 28D and set the outward limit for movement of these rings 28.

The first and second driver rings 28D are connected to the connecting bracket 40 by passing a fastener 48 through the two components. In the arrangement shown, fastener 48 extends through the center of the bottom of driver rings 28D and horizontal member 42 thereby connecting the two components in rigid fashion. Fasteners 48 are any form of a fastening device such as a screw or bolt, a snap fit feature, or any other fastening member that connects two components together.

Horizontal member 42 also includes one or more mounting features 50 positioned in the horizontal member 42 between the opposing driver rings 28D. Mounting features 50 are used to mount an activating device 52 to the connecting bracket 40 that turns on and/or turns off the system 10. Mounting features 50 are formed of any suitable size, shape and design. In the arrangement shown, mounting features 50 are formed of a rectangular opening and/or a circular opening positioned in spaced alignment to one another along the length of the horizontal member 42. These openings are used to hold and house the components of the activating device 52.

Vertical member 44 includes one or more hook openings 54 that are used to hold a drapery hook 36, clip or other component that holds drapery material 38 and connects it to connecting bracket 40. Vertical member 44 also includes a mounting slot 56 or other opening or feature therein that is used to mount crossover bracket 58 thereto. There are two crossover brackets 58 used in association with the system 10, an inside crossover bracket 58I and an outside crossover bracket 58O. Inside crossover bracket 58I and outside crossover bracket 58O perform the function of extending the inward most edge of the drapery material 38 past the inward most edge of the inward most driver ring 28D. In this way, the opposing crossover brackets 58I and 58O when in a closed position, position the inward most edges of drapery material 38 in an overlapped condition, thereby preventing or eliminating any light gaps that may occur. That is, if the crossover brackets 58I and 58O are not used, when in a closed position the drapery material 38 merely hangs straight downward from the inward most driver ring 28D thereby causing a light-gap between the two.

Crossover brackets 58 are formed of any suitable size, shape and design. In the arrangement shown, the inside crossover bracket 58I is formed of a generally flat and straight member that includes a pair of circular openings that receive conventional fasteners 60 therein. Fasteners 60 extend through the openings in inside crossover bracket 58I and through mounting slots 56 and are fastened together thereby joining the two components. The use of a pair of fasteners 60 helps to keep the parallel and horizontal alignment of crossover bracket 58 with respect to the connecting bracket 40. Also, the use of a slot 56 allows for lateral adjustment of the amount the crossover brackets 58 overlap. That is, the use of slot 56 allows the user to adjust the amount of overlap or the amount that inside crossover bracket 58I extends past the inward most edge of the inside driver ring 28D. The inward most edge of the inside crossover bracket 58I terminates in a slightly inwardly bent elbow 62 that includes a hook opening 54 that holds a drapery hook 36. Inside crossover bracket 58I attaches to the forward edge of vertical member 44 which is positioned on the forward side of horizontal member 42.

In the arrangement shown, the outside crossover bracket 58O is has a first length 64 that is formed of a generally flat and straight member that includes a pair of circular openings that receive conventional fasteners 60 therein. Fasteners 60 extend through the openings in outside crossover bracket 58O and through mounting slot 56 and are fastened together thereby joining the two components together. The use of a pair of fasteners 60 helps to keep the parallel and horizontal alignment of crossover bracket 58 with respect to the connecting bracket 40. Also, the use of a slot 56 allows for lateral adjustment of the amount the crossover brackets 58 overlap. The outside edge of the first length 64 is connected to a corner section 66 that loops around towards the forward side of the system 10 and connects to an angled section 68 that extends forward at an angle to the length of rod 12. Angled section 68 connects to a parallel section 70 that extends a length parallel to the length of rod 12. The inward most edge of the parallel section 70 connects to slightly inwardly bent elbow section 62 that includes a hook opening 54 that holds a drapery hook 36. Outside crossover bracket 58O attaches to the rearward edge of vertical member 44 which is positioned on the rearward side of horizontal member 42.

In this arrangement, when in a closed position, the inward most edge of the outside crossover bracket 58O is positioned in front of the inward most edge of the inside crossover bracket 58I. In this way, an overlapped condition of the drapery material 38 is provided thereby eliminating light gaps. Because the two driver rings 28D are connected together by connecting bracket 40 this helps to maintain the perpendicular alignment of the two driver rings 28D with respect to the rod 12. This provides smoother operation, reduced amount of catastrophic events and allows for the inner edge of the drapery material 38 to be extended past the inner edge of the inward most driver ring 28 without causing that ring 28D to tilt and bind on the rod 12.

Figure 8:
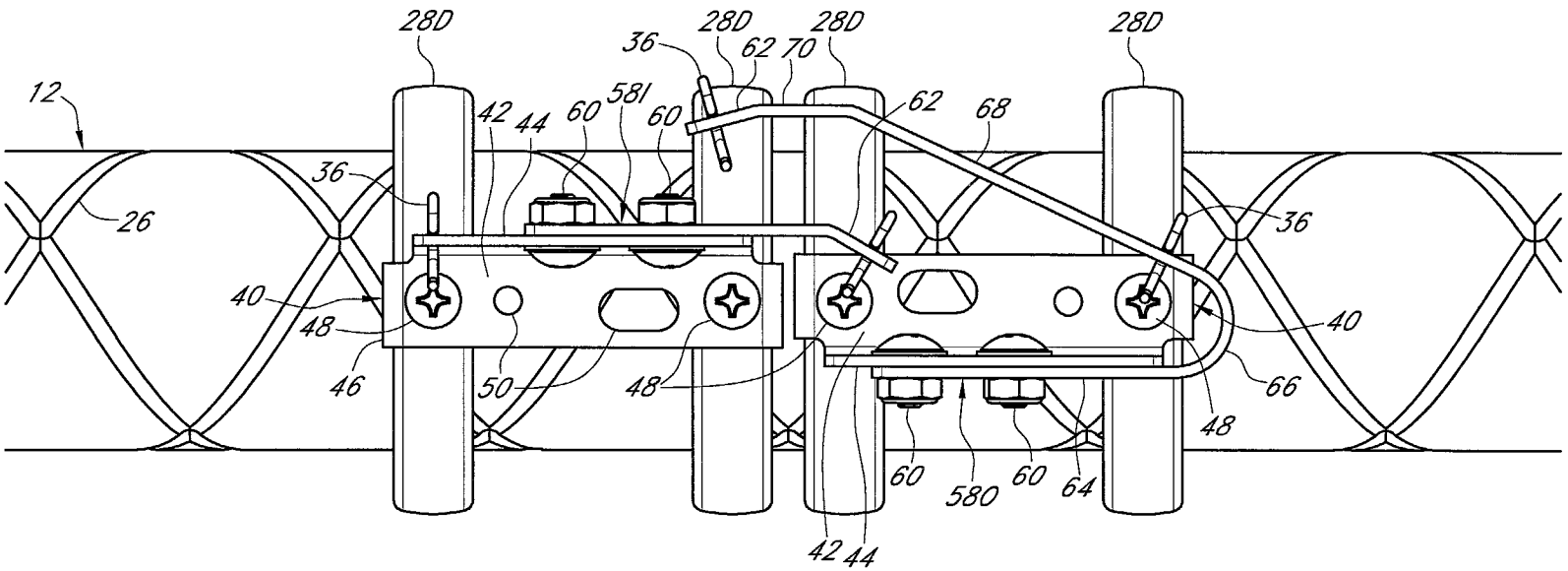
FIG. 8 is a close up bottom elevation view of the arrangement of FIG. 3, with the two crossover brackets in a fully closed position.
Figure 9:
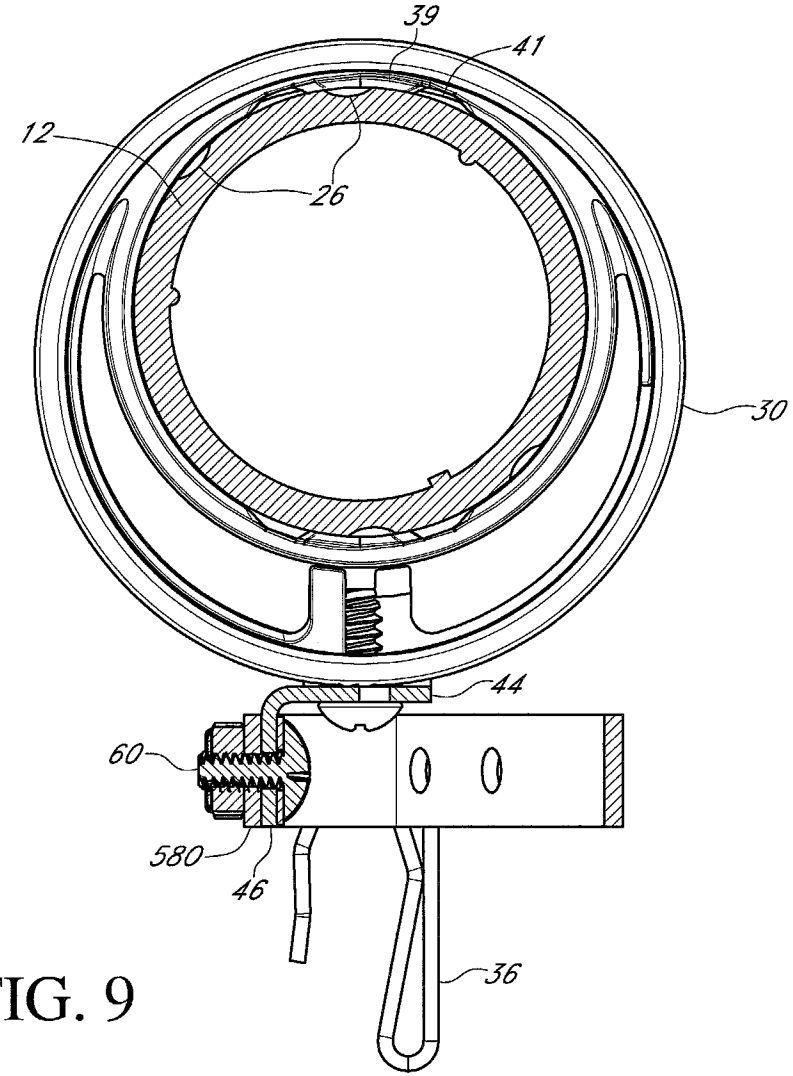
FIG. 9 is a side cut-away elevation view of the system, the view showing a driver ring of the crossover bracket, a driver tooth engaged in a groove of the rod.
Figure 10:
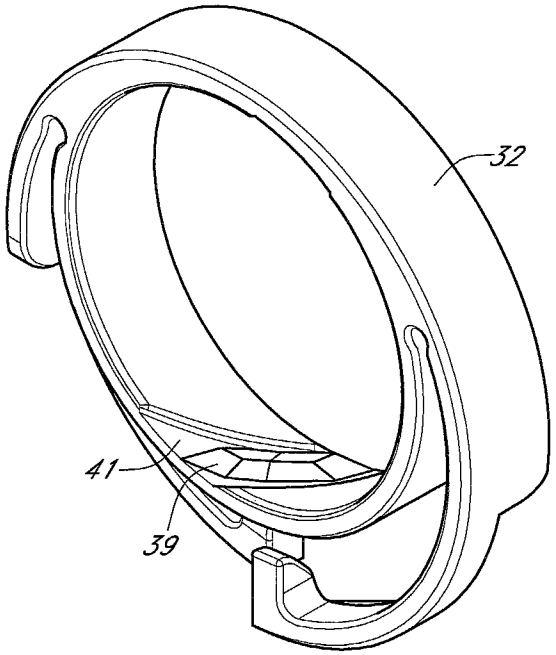
FIG. 10 is a top perspective view of an insert for a driver ring.
Figure 11:
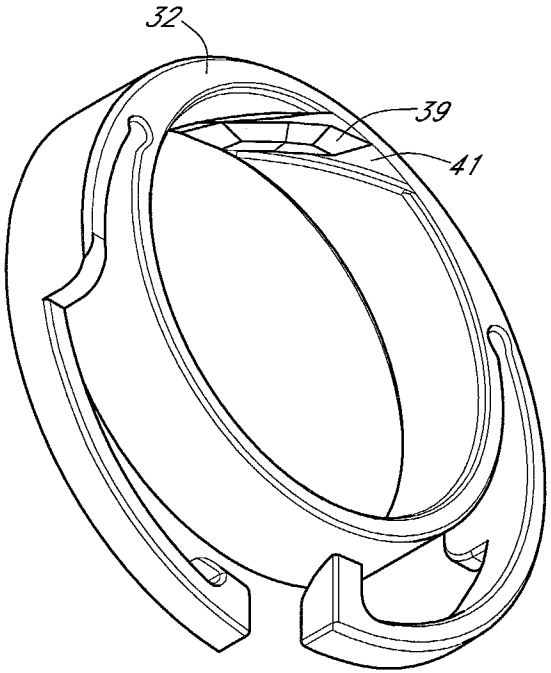
FIG. 11 is a bottom perspective view of an insert for a driver ring.
Figure 12:
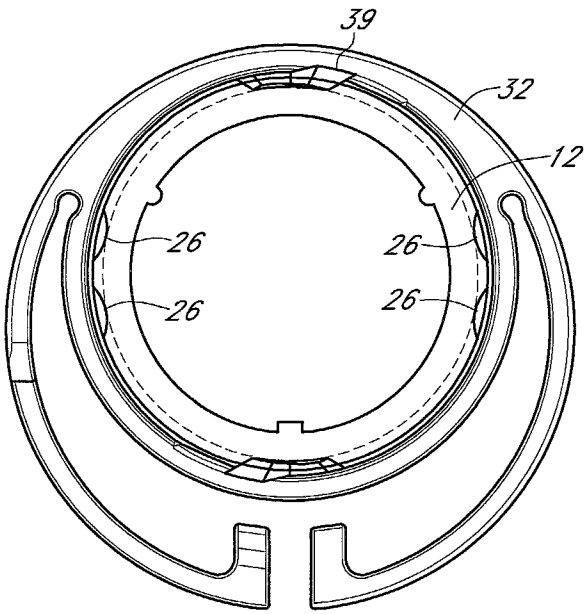
FIG. 12 is a side elevation view of an insert for a driver ring positioned around a drapery rod.
Figure 13:
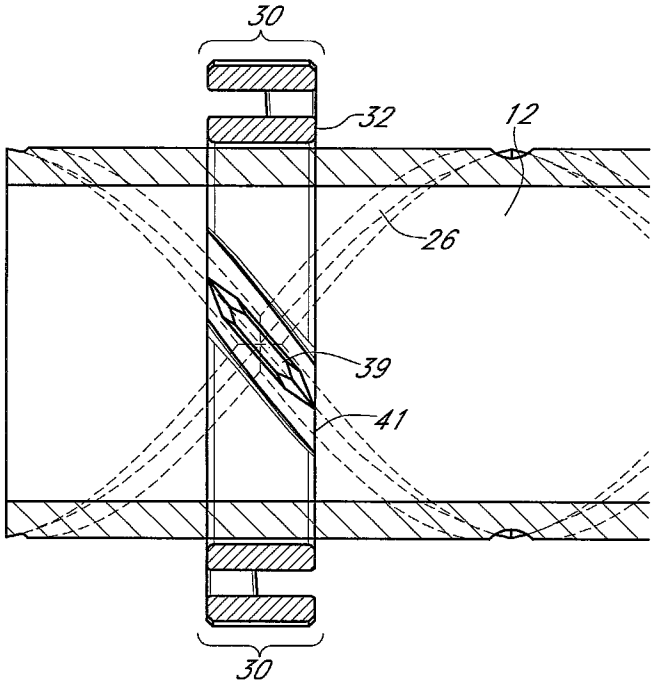
FIG. 13 is a front cut-away view of a driver ring positioned around a drapery rod.
Figure 14:
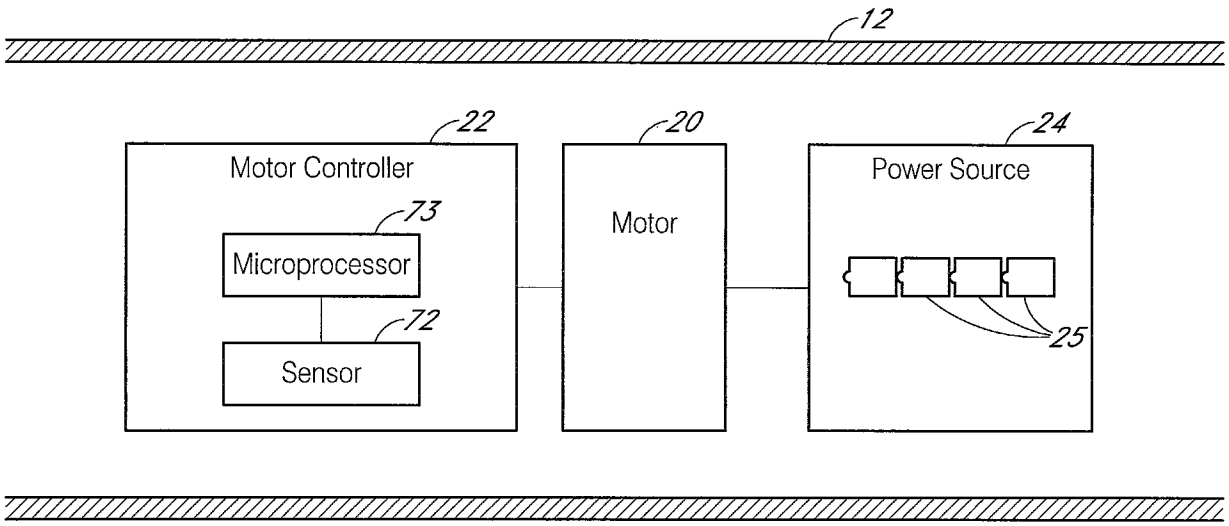
FIG. 14 is a plan view of the interconnection of the electrical components of the system.

To facilitate overlapping, as can be seen in FIG. 8, the vertical member 44 on one connecting bracket 40 is positioned towards one side (the rearward or forward side) whereas the other vertical member 44 on the other connecting bracket 40 is positioned towards the opposite side (the rearward or forward side) of the drapery system 10. By staggering or positioning the vertical members 44 on opposite sides, this prevents the vertical members 44, or any crossover bracket 58 connected thereto, from engaging one another when in a fully closed position.

An additional improvement to the system is that because the two driver rings 28D help to maintain the alignment of one another the tolerances between the inner surface of interior insert 32 and the exterior surface of rod 12, as well as the tolerances between the teeth 39 and guide structure 26 do not have to be as tightly controlled. This is because the alignment of the rings 28D is not provided solely by the inner surface of the insert 32 of driver rings 28D. This provides a smoother and more robust design and operation.

In addition, in one arrangement one, or both of the driver rings 28D may include only a single tooth 39 positioned at the top dead center of the ring 28. This single tooth 39 may provide the necessary alignment while reducing the operational friction of the system 10. In one arrangement, the inward most driver ring 28D includes a tooth 39 at the top dead center and bottom dead center while the second inward most driver ring 28D only includes a single tooth 39 at the top dead center. Alternatively, this arrangement is swapped, and the inward most driver ring 28D includes only includes a single tooth 39 at the top dead center whereas the second inward most driver ring 28D includes a tooth 39 at the top dead center and bottom dead center. In yet another alternative arrangement, both driver rings 28D includes only includes a single tooth 39 at the top dead center. In yet another alternative arrangement, both driver rings 28D include a tooth 39 at the top dead center and bottom dead center. In yet another alternative arrangement, one or both driver rings 28D include a tooth 39 at the left most position and at the right most position. Any other arrangement of teeth 39 is hereby contemplated.

Drapery system 10 also includes a sensor 72 connected to the motor 20 and/or motor controller 22 by any means. Sensor 72 senses vibrations or disturbances and transmits these signals to a microprocessor 73 of the motor controller 22. The microprocessor 73 interprets these signals and determines whether the signal meets predetermined parameters and if they do the microprocessor 73 activates or deactivates the motor 20 according to instructions.

In one arrangement, when the microprocessor 73 receives a signal from sensor 72 that meets the predetermined parameters, and the system 10 is not moving, the microprocessor 73 activates the motor 20 to drive the rotating rod 12 in the opposite direction of the last movement. In one arrangement, when the microprocessor 73 receives a signal from sensor 72 that meets the predetermined parameters, and the system 10 is moving, the microprocessor 73 deactivates the motor 20 to stop the opening or closing process, or alternatively reverses the direction of the motor 20.

Sensor 72 can detect any signal transmitted such as a tug on the drapery material 38, a tap by a wand 74 connected to a ring 28, a manual sliding of the rings 28 across a length of the drapery rod 12, or any other disturbance. To ensure a repeatable signal is generated, activating device 52 is employed. Activating device 52 is any device that causes a signal to be transmitted to sensor 72. In one arrangement, activating device 52 is connected to connecting bracket 40. In one arrangement, activating device 52 is a spring loaded device that when actuated taps rotating rod 12 thereby transmitting a vibration along the length of rod 12 that is sensed by sensor 72.

In one arrangement, wand 74 is connected to the bottom side of horizontal member 42 of connecting bracket 40. Wand 74 is connected by a fastener 76, such as a screw, bolt, shaft or the like with a surrounding spring 78 positioned on the upper side of the horizontal member 42 and held by a flange or head. The fastener 76 extends through the horizontal member 42 and threadably or frictionally fastens to the wand 74. As the wand 74 is pulled vertically, the spring 78 compresses and the head of fastener 76 moves downward towards the top surface of horizontal member 42. Positioned adjacent the wand 74, fastener 76, spring 78, assembly is a spring loaded plunger 80 that is activated when the wand 74 is pulled.

Spring loaded plunger 80 is formed of any suitable size, shape and design. In the arrangement shown, the plunger 80 includes a spring arm 82 with a stop 84, that is adjustable, positioned at or adjacent the end of the spring arm 82. Spring arm 82 is, in one arrangement, formed of a piece of spring steel that connects to any portion of the connecting bracket 40. In one arrangement, spring arm 82 connects to the horizontal member 42 by a fastener that extends through horizontal member 42 and fastens spring arm 82 to connecting bracket 40. In an alternative arrangement, spring arm 82 connects to the horizontal member 42 by any other manner or method such as being formed of the same piece of material, by welding, by adhesive or the like.

In the arrangement shown, the adjustable stop 84 is formed of a conventional screw that is held onto spring arm 82 by way of a pair of locking nuts, one positioned on either side of the spring arm 82. In this way, the head of adjustable stop 84 is locked into place on spring arm 82 while the height is adjustable by rotating the screw through the opposing nuts.

In a static position, the inward most edge of spring arm 82 is positioned below an overhanging lip of the head of fastener 76 that connects to wand 74 and the upper surface of adjustable stop 84 is positioned a slight distance away from the exterior surface or bottom surface of rod 12. As the wand 74 is pulled downward, the spring 78 compresses and the bottom edge of the head of fastener 76 engages the inward upper edge of spring arm 82. After the head of fastener 76 engages the inward edge of spring arm 82 and the wand 74 is pulled further down the spring arm 82 is deflected downward and the distance between the bottom of rod 12 and the top of adjustable stop 84 grows as potential energy is built up in the spring arm 82. This continues until the inward edge of spring arm 82 slips past the outward edge of fastener 76 at which point the spring arm 82 is free to swing towards the rod 12 as the potential energy in spring arm 82 is released. Due to the increased mass positioned at the end of spring arm 82 due to the adjustable stop 84, the spring arm 82 swings past its static position and the top edge of adjustable stop 84 hits, engages or clicks the rod 12. This engagement causes a vibration to transmit down the rod 12 which is sensed by the sensor 72.

After this hit, engagement or click, when the wand is released 74, the spring 78 connected to the wand 74 forces the fastener 76 upward. This causes the rounded, angled or sloped top surface of fastener 76 to engage the bottom surface of the inward edge of the spring arm 82. After engagement, the spring 78 continues to push the rounded, angled or sloped top surface of fastener 76 upward, causing the spring arm 82 to deflect slightly upward as the end of spring arm 82 slides down the top rounded, angled or sloped top surface of fastener 76. This continues until the spring arm 82 slips off the fastener 76 and travels below the lip or edge of the head of fastener 76. In this way, the activating device 52 is returns to its static position by the resilient spring force in both the spring 78 connected to wand 74 and the spring arm 82 and the system is back in its static position, at which point the process can be repeated.

This arrangement is repeatable because the fastener 76 pulls down the spring arm 82 to very similar a release point each and every time. This causes the adjustable stop 84 to engage the rotating rod 12 with approximately the same amount of force every time the wand 74 is pulled. This arrangement is advantageous because the engagement between the adjustable stop 84 and the rotating rod 12 is the similar regardless of how hard, fast or slow the wand 74 is pulled down. Because the hit, click or engagement is similar regardless of the manner in which the wand 74 is pulled, the sensor 72 can be tuned tightly, closely and specifically to that signal that is generated by this engagement with a narrow range allowing the sensor 72 and/or microprocessor 73 to ignore all other signals. This narrow tuning allows the sensor 72 and/or microprocessor 73 to avoid activating the motor 20 in response to false signals, such as doors slamming, thunder claps, fireworks, lout music, wind blowing on the drapery through an open window, a loud car, truck or motorcycle driving by, etc. that are sensed in the environment.

In Operation: A plurality of rings 28 are positioned around the rotating tube 12 and a panel of material, such as drapery material 38, is connected to the rings 18. In the arrangement shown, in a center-closing drapery system 10, a pair of crossover bracket members are positioned at the inward sides of stacks of rings 28. Each of these crossover bracket members include an inward most ring 28 and a second inward most ring 28 connected together by a connecting bracket 40. One or both of the inward most ring 28 and second inward most ring 28 include at least one tooth 39 that engages a groove of the guide structure 26.

When activated, the motor 20 causes the rod 12 to rotate. As the rod 12 rotates, the engagement of the teeth 39 of the inward most ring 28 and second inward most ring 28 cause the crossover bracket members to be driven laterally along a length of the rod 12. As the crossover bracket members are driven along a length of the rod 12, the weight of the drapery material 38 hanging down from the rings 28 helps to keep the rings 28 in a vertical alignment. As the crossover bracket members are driven along a length of the rod 12, the connecting bracket 40 also helps to maintain the vertical alignment and spacing of the inward most ring 28 and second inward most ring 28. That is, connecting the inward most ring 28 and second inward most ring 28 provides smoother and more robust operation as the two rings connected together help to maintain alignment of one another.

In addition, by connecting the inward most ring 28 and second inward most ring 28 by the connecting bracket 40, this allows for the inward edge of drapery material 38 to be extended a distance past the inward most edge of the inward most ring 28 by a crossover bracket 58 (58I or 58O). By extending the drapery material 38 a distance past the inward most edge of the inward most ring 28 this creates a moment that has the tendency to tilt the inward most ring 28. However, by connecting the inward most ring 28 and second inward most ring 28 to one another by the connecting bracket 40, this helps to prevent tilting.

As the motor 20 rotates rod 12 the connecting bracket members are driven along a length of the rod 12, between an open position, wherein the connecting bracket members are toward the outward ends 14 of the rod 12 with the rings 28 stacked in close relation to one another; and a closed position, wherein the inward edges of the connecting bracket members are adjacent one another with the rings 28 in spaced relation to one another. When in a closed position, the crossover bracket 58 (58I or 58O) of one crossover bracket member is in overlapping condition with the crossover bracket 58 (58I or 58O) of the other crossover bracket member. This causes the inward edges of the opposing drapery materials 38 to similarly be in overlapping condition. This prevents or eliminates a light gap between the two drapery materials 38 when in a closed position.

To activate the activation device 52, a user grasps the wand 74 connected to the connecting bracket 40. As the user pulls the wand 74, this causes the head of fastener 76 to move downward and further causes spring 78 to compress. As the head of fastener 76 moves downward the bottom surface of the lip of the head of fastener 76 engages the top surface of the inward edge spring arm 82. After this engagement, as the wand 74 is continued to be pulled downward, the spring arm 82 begins to deflect downward. As the spring arm 82 deflects downward, a torque or force is built up within the spring arm 82. The spring arm 82 continues to deflect downward until the upper inward edge of spring arm 82 slides past the lower lip the head of fastener 76, causing the spring arm 82 to be released. Once released, the spring arm 82 rapidly swings upward and past its static position, due in part to the mass of stop member 84 connected adjacent the end of spring arm 82. As the spring arm 82 swings past the static position, the upper edge of stop member 84 engages the exterior surface of rod 12. As the stop member 84 engages the rod 12 a vibration is generated that extends through the rod 12. After striking the rod 12 the spring arm 82 returns to its static position.

After the user pulls the wand 74 all the way down and releases the wand 74, the spring 78 forces the fastener 76 upward. This causes the upper rounded or angled surface of the head of fastener 76 to engage and slide upward against the bottom inner surface of spring arm 82. This upward movement continues until the bottom inner surface of spring arm 82 slides off and past the upper surface of the head of fastener 76. Once the spring arm 82 slides past the lip of fastener 76 the activating device 52 is reset and ready for another operation. In this way, the first member (wand 74, fastener 76 and spring 78) and second member (spring arm 82 and stop member 84) work in concert to strike rod 12 in a repeatable manner.

When the stop member 84 engages the rod 12, the vibration is sensed by sensor 72. Sensor 72 transmits the sensed vibrational signal to the microprocessor 73 of motor controller 22. If the vibration meets or fits within predetermined parameters the motor 20 is activated or deactivated. If the motor 20 is not operating when the signal is received, the motor 20 is activated to drive in the opposite direction as the last movement. If, on the other hand, the motor is operating when the signal is received, the motor 20 is deactivated.

Users are accustomed to pulling wands connected to drapery material 38 to move the drapery material 38. In this way, by activating the activating device 52 by pulling the wand 74 this is intuitive to the average user and provides a simple, easy, repeatable and pleasurable operating experience.

From the above discussion and the accompanying drawings and claims it will be appreciated that the improved driver for a rotating rod drapery system presented offers many advantages over the prior art. That is, the system presented offers improves upon the state of the art; reduces the light gap between drapes; improves the overlap between opposing drapes; provides smoother opening and closing; provides better alignment for the driver rings; reduces the potential for catastrophic events, such as the driver ring rotating around the rod; allows for the use of an overlap bracket; allows for adjustability; is easy to use; is durable; has an intuitive design; has a minimum number of parts; has a long useful life; provides a convenient mounting place for an activating device; allows the inner edge of a drapery panel to be extended inward from a driver ring; prevents or reduces a driver ring from hanging-up or catching on the drapery rod; reduces the need to closely control the dimensions between the drapery rod and the driver ring; provides more give and forgiveness to the system; improves safety; improves convenience; improves the universality of the device; reduces false activation of the device; improves repeatable activation of the device; among countless other advantages. As such, the invention meets more than its stated objectives.

It will be appreciated by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included within the spirit and purview of this application.

What is claimed:

1. A drapery system comprising:

a rod extending a length and having a cylindrical exterior surface;

the rod having a first helical guide structure and a second helical guide structure positioned in the exterior surface of the rod;

a plurality of rings positioned around the rod;

the plurality of rings including an inward most ring and a second inward most ring;

wherein the inward most ring and the second inward most ring are connected together by a connecting bracket such that the inward most ring and the second inward most ring are maintained in spaced relation to one another by the connecting bracket as they travel across a length of the rod;

wherein the inward most ring and the second inward most ring are engaged with at least one of the first helical guide structure or second helical guide structure such that when the rod is rotated, the inward most ring and the second inward most ring are moved along a length of the rod.

2. The drapery system of claim 1 further comprising a motor connected to the rod, the motor configured to rotate the rod thereby opening and closing the plurality of rings.

3. The drapery system of claim 1 further comprising wherein the inward most ring includes at least one tooth that engages at least one of the first helical guide structure or second helical guide structure of the rod such that when the rod is rotated the inward most ring is driven across a length of the rod.

4. The drapery system of claim 1 further comprising wherein the second inward most ring includes at least one tooth that engages at least one of the first helical guide structure or second helical guide structure of the rod such that when the rod is rotated the second inward most ring is driven across a length of the rod.

5. The drapery system of claim 1 further comprising:

an activating device connected to the connecting bracket;

wherein the activating device engages the rod when activated.

6. The drapery system of claim 1 further comprising:

an activating device connected to the connecting bracket;

wherein the activating device strikes the rod thereby generating vibrations that are sensed by a sensor;

wherein the sensor activates a motor operatively connected to the rod.

7. The drapery system of claim 1 further comprising:

a sensor connected to the rod;

wherein the sensor senses vibrations and selectively activates a motor operably connected to the rod to rotate the rod.

8. The drapery system of claim 1 further comprising:

a crossover bracket section connected to the connecting bracket;

wherein the crossover bracket section extends a distance past an inward side of the inward most ring.

9. A drapery system comprising:

a rod having a cylindrical exterior surface;

the rod extending a length between opposing ends;

a first helical guide structure and a second helical guide structure positioned in the exterior surface of the rod;

a first driver ring and a second driver ring positioned around the rod and connected together by a connecting bracket; and wherein the first driver ring and the second driver ring each have a tooth that engages at least one of the first helical guide structure or second helical guide structure such that when the rod is rotated the first driver ring and the second driver ring are driven across a length of the rod;

wherein when the first driver ring and the second driver ring are driven across a length of the rod the connecting bracket serves to maintain the alignment of the first driver ring and the second driver ring.

10. The drapery system of claim 9 wherein the first driver ring includes the tooth positioned on a top inner circumferential surface of the first driver ring.

11. The drapery system of claim 9 wherein the first driver ring includes the tooth positioned on a bottom inner circumferential surface of the first driver ring.

12. The drapery system of claim 9 wherein the second driver ring includes the tooth positioned adjacent a top surface of the second driver ring.

13. The drapery system of claim 9 wherein the second driver ring includes the tooth positioned adjacent a bottom surface of the second driver ring.

14. The drapery system of claim 9 wherein the second driver ring includes:

a top surface with the tooth positioned adjacent to the top surface; and a bottom surface which is smooth.

15. The drapery system of claim 9 further comprising:

a sensor connected to the rod, the sensor configured to sense vibrations and activate a motor; and the motor operatively connected to the rod, wherein the motor is activated by the sensor in response to sensed vibrations.

16. The drapery system of claim 9 further comprising an activating device connected to the bracket, when actuated the activating device is configured to engage the rod thereby generating vibrations in the rod.

17. A drapery system comprising:

a rod having an exterior surface;

the rod extending a length between opposing ends;

a first helical guide structure and a second helical guide structure positioned in the exterior surface of the rod;

a first ring and a second ring positioned around the rod;

the first ring and the second ring connected together by a connecting bracket such that the first ring and the second ring are positioned in spaced alignment and maintained in spaced alignment by the connecting bracket;

an activating device connected to the bracket;

wherein when activated, the activating device strikes the rod thereby generating vibrations in the rod;

a sensor operatively connected to the rod;

wherein the sensor sensed vibrations caused when the activating strikes the rod.

18. The drapery system of claim 17 wherein the sensor is tuned to sense vibrations caused when the activating device strikes the rod within predetermined parameters.

19. The drapery system of claim 17 wherein the sensor is operably connected to a microprocessor and a motor, such that when the sensor senses vibrations within predetermined parameters the sensor transmits a signal to the microprocessor that activates the motor.

20. The drapery system of claim 17 wherein when activated the rod rotates thereby opening or closing a curtain connected to the first ring and second ring.

21. The drapery system of claim 17 wherein one of the first ring or the second ring have a tooth that engages at least one of the first helical guide structure or second helical guide structure of the rod such that when the rod is rotated the first ring and the second ring are driven across a length of the rod.

22. The drapery system of claim 17 wherein the activating device includes a spring arm that strikes the rod when deflected and released.

23. The drapery system of claim 17 wherein the activating device includes a wand that releases a spring arm that strikes the rod.

24. A drapery system, comprising:

a rod extending a length;

the rod having a cylindrical exterior surface;

a first helical guide structure and a second helical guide structure positioned in the exterior surface of the rod;

a pair of crossover bracket members connected to the rod;

the pair of crossover bracket members each having an inward most ring and a second inward most ring connected together by a connecting bracket;

the pair of crossover bracket members each having a crossover bracket connected to the connecting bracket, the crossover bracket extending past an inward edge of the inward most ring;

wherein the pair of crossover bracket members move along a length of the rod between an open position and a closed position; and wherein when the crossover bracket members are in a closed position, the crossover brackets are positioned in an overlapping condition;

wherein the inward most ring and second inward most ring of each crossover bracket member are engaged with at least one of the first helical guide structure or second helical guide structure.

25. The drapery system of claim 24, further comprising a panel of material connected to each of the connecting brackets such that when in a closed position, an inner edge of the panels of material are positioned in overlapping condition thereby preventing light gaps between the panels of material.

26. The drapery system of claim 24, further comprising an activating mechanism connected to at least one of the crossover bracket members, the activating mechanism configured to engage the rod when actuated thereby generating a vibration.

27. A drapery system comprising:

a rod extending a length and having a cylindrical exterior surface;

the rod comprising a first helical guide structure and a second helical guide structure positioned in the exterior surface of the rod;

a first ring and a second ring positioned around the rod;

the first ring and the second ring connected together by a connecting bracket such that the first ring and the second ring are positioned in spaced alignment and maintained in spaced alignment by the connecting bracket;

wherein the first ring and the second ring are engaged with at least one of the first helical guide structure or the second helical guide structure;

a motor operatively connected to the rod;

a motor controller operatively connected to the motor and configured to control the motor;

a sensor operatively connected to the rod and the motor controller;

an activating mechanism operatively connected to the rod; and the activating mechanism having a first member that selectively engages a second member;

thereby causing the second member to strike the rod thereby generating vibrations in the rod;

wherein when the motor is activated the rod is rotated and the first ring and second ring are driven along a length of the rod thereby opening or closing the drapery system.

28. The drapery system of claim 27, wherein the first member includes a fastener connected to a wand with a spring member positioned between the fastener and the wand.

29. The drapery system of claim 27, wherein the second member includes a stop member connected to a spring arm, wherein the stop member strikes the tube when the spring arm is deflected and released by the first member.

30. The drapery system of claim 27, wherein the sensor is configured to sense the vibrations generated by the second member engaging the rod and in response the motor is activated thereby opening or closing the drapery system.

* * * * *